US007409264B2

(12) United States Patent
Mockli

(10) Patent No.: US 7,409,264 B2
(45) Date of Patent: Aug. 5, 2008

(54) CONTROL OF AN INSTALLATION FOR GATHERING FLEXIBLE PRODUCTS

(75) Inventor: Ernst Mockli, Fehraltdorf (CH)

(73) Assignee: Ferag AG, Hinwil (CH)

( * ) Notice: Subject to any disclaimer, the term of this patent is extended or adjusted under 35 U.S.C. 154(b) by 438 days.

(21) Appl. No.: 11/015,579

(22) Filed: Dec. 17, 2004

(65) Prior Publication Data

US 2005/0137743 A1 Jun. 23, 2005

(30) Foreign Application Priority Data

Dec. 19, 2003 (CH) ..... 2200/03

(51) Int. Cl.

| | |
|---|---|
| ***G06F 7/00*** | (2006.01) |
| ***B42B 2/00*** | (2006.01) |
| ***B42B 2/02*** | (2006.01) |
| ***B65H 5/30*** | (2006.01) |
| ***B65H 39/00*** | (2006.01) |
| ***B65H 39/02*** | (2006.01) |
| ***B65H 41/00*** | (2006.01) |

(52) U.S. Cl. ..... 700/223; 700/213; 270/52.04

(58) Field of Classification Search ..... 270/52.04, 270/52.06, 52.14, 52.16; 700/222, 220, 223
See application file for complete search history.

(56) References Cited

U.S. PATENT DOCUMENTS

| | | | | |
|---|---|---|---|---|
| 3,953,017 A | | 4/1976 | Wise | |
| 4,072,304 A | | 2/1978 | Brown et al. | |
| 4,566,681 A | | 1/1986 | Bottcher et al. | |
| 4,936,562 A | | 6/1990 | Rowe | |
| 4,966,354 A | | 10/1990 | Grunder | |
| 5,321,624 A | * | 6/1994 | Helffrich et al. | 700/222 |
| 5,608,639 A | | 3/1997 | Twardowski et al. | |
| 6,082,724 A | * | 7/2000 | Kahlig et al. | 270/52.14 |
| 6,249,716 B1 | * | 6/2001 | Edens et al. | 700/222 |

FOREIGN PATENT DOCUMENTS

| | | |
|---|---|---|
| EP | 1 072 550 A2 | 1/2001 |
| EP | 1 338 542 A1 | 8/2003 |

OTHER PUBLICATIONS

WO 94/20400, Process for the Selective Production of Printed Products, Publication Date: Sep. 15, 1994.

* cited by examiner

*Primary Examiner*—Gene O. Crawford
*Assistant Examiner*—Ramya G Prakasam
(74) *Attorney, Agent, or Firm*—Rankin, Hill & Clark LLP

(57) ABSTRACT

A method and control system for controlling an installation (1) for gathering flexible individual products (10), in which installation a stream of collections (20), which are from supplied streams that each have one individual product type, can be formed and conveyed to further processing (3). Each collection (20) has a predetermined quantity of individual products (10). Faulty collections (20) containing a supply fault with regard to one or several individual products are not processed separately but are regarded as faultless collections (20) under certain conditions. Accordingly, faulty collections are advantageously not conveyed to a fault corrective action until a quota of the faulty collections exceeds a predetermined reference limit.

14 Claims, 3 Drawing Sheets

CONTROL OF AN INSTALLATION FOR GATHERING FLEXIBLE PRODUCTS

BACKGROUND OF THE INVENTION

1. Field of the Invention

The invention concerns the area of conveying and handling objects, in particular printed objects and supplements. It relates to a method, a computer program system and a control system for the control of an installation for the gathering of flexible individual products.

2. Description of the Related Art

When products are collated in the printing industry, a predetermined selection of products is gathered in a collection and this collection is further processed. Therein employed are e.g. gatherer-stitchers for periodicals, inserting drums for newspapers and other gathering machines for bookbinding. A collection comprises e.g. the following individual products: a periodical, several advertising brochures, a flatpack toy supplement, and a personalized address sheet. In the subsequent processing the collection is e.g. foil wrapped.

The individual products or part products are typically flexible, flat and/or thin, and are directed by associated means of supply into a gathering machine. There a collection is formed e.g. by superposing the individual products on to a clocked product stream. According to the state-of-the-art technology a faultless functioning of the means of supply is of great importance, ensuring that every collection comprises the correct composition, i.e. receives all the required part products. To warrant this, e.g. a particular means of supply is monitored to ascertain its correct functioning, in particular whether it actually puts an individual product into the collection at a specified clock speed. If this is not the case, the incomplete collection is discharged or segregated, in other words removed, rejected or released, prior to further processing. If several individual products repeatedly fail to be supplied, the gathering machine may be switched off or reset. Alternatively, a primary means of supply with important or critical individual products can be provided with a backup means of supply, which inserts the missing individual product during the temporary failure of the primary means of supply. Thus a high quality of collection is guaranteed, this however requires a large expenditure of machinery, the production is slowed down, or requires a laborious process of processing the segregated collections.

In the case of non-critical individual products such a control may not be necessary. Thereby it is accepted, however, that one or several individual products are missing in an unknown or uncontrollable quantity of collections.

SUMMARY OF THE INVENTION

The present invention is directed to a method, a computer program system and a control system for the control of an installation for gathering flexible individual products of the kind mentioned at the start, which eliminates the aforementioned disadvantages.

The present invention also allows the adjustment of the production of collections to predetermined quality requirements as flexibly and exactly as possible. Therein the technical input and an additional workload should also be optimally adjustable to the quality requirements.

The problems associated with the prior art are solved by a method, a computer program system and a control system for the control of an installation for gathering flexible individual products.

The method for the control of an installation for gathering flexible part products, in particular printed products, comprises the steps of gathering part products from supplying streams of one individual product type each;

forming a stream of collections and conveying the collections to further processing, wherein each collection consists of a predetermined quantity of part products; and processing faulty collections in the same manner as faultless collections only when predetermined conditions are satisfied.

The following terms are used in connection with the invention:

A supply fault relating to a type of individual product occurs when a means of supply for this type of individual product delivers a faulty individual product. "Faulty" means e.g. a part product being omitted, delivered repeatedly, or delivered in a faulty condition. A supply fault is advantageously detected at the relevant means of supply, but in principle can also be determined in a partly or completely gathered collection by suitable means of detection at some point downstream. A supply fault is advantageously designated to a particular accompanying position in the timed stream of products and thus also to a collection. A collection can also reveal or contain several supply faults relating to several faulty individual products.

A faultless collection comprises no supply faults.

A faulty collection comprises at least one supply fault, is therefore faulty concerning at least one individual product type.

An tolerated faulty collection is faulty but is treated as if it were faultless. I.e. it is further processed like a faultless collection.

A not tolerated faulty collection is faulty and is conveyed to a fault corrective action. I.e. it is e.g. segregated, disassembled, marked or replenished during further processing.

The total quantity of faultless collections and of tolerated faulty collections is marked as the quantity of collections considered faultless.

Thus a gathering machine is controlled wherein a stream of collections can be formed from supplied streams of individual product types and can be supplied to a further processing situated downstream. Each collection consists of a predetermined quantity of individual products of the various types, wherein the collection usually contains one copy of each type. Therein faulty collections, containing a supply fault concerning one or more individual products, are conditionally treated like faultless collections. Advantageously they are not conveyed to a fault corrective action before a quota of faulty collections has reached a particular reference limit.

This quota is defined either as an absolute number of faults or relative to a total quantity of individual products or of collections. The reference limit is e.g. specified by a user or calculated in the control system, wherein it can also be changed dynamically during production. An individual product, as viewed in the gathering process described above, can in itself be a collection from a previous gathering process.

The invention has the advantage that it allows for a predetermined maximum quota of faulty collections or supply faults to be set in advance, and if necessary also to be changed during the operation. Concerning each individual product type, or even particular fault combinations, a maximum fault quota or a maximum fault rate can be guaranteed.

There is the further advantage that this fault quota can be fully exploited, thus maximising the net capacity of the system. A fault corrective action of faulty collections only takes place if the actual fault quota has reached the predetermined limit. From this point forward only actually faultless collections are processed as faultless.

The further processing corresponds with a desired normal operation, e.g. foil wrapping, stapling, binding, stacking, strapping, or other packaging.

The fault corrective action leads to a faulty collection being processed separately immediately after gathering or at some other point in the further processing. To this end the collection can be marked. This can be achieved physically by attaching a marker, or by computer wherein e.g. a data record designated to the collection comprises information concerning one or several faults of the collection. It is also possible to activate a segregation situated downstream with a relevant delay after the detection of a supply fault.

The separate processing advantageously consists of segregating and/or replenishing faulty collections and/or faulty collections being returned to the installation for the gathering. Faulty collections are e.g. segregated into a slower conveying system, replenished or corrected manually, then incorporated back into the main stream. Or, segregated collections are conveyed to the start of the gathering machine and there automatically replenished with the missing individual product. To this end the position and composition of each collection is registered in a control system and the machinery is regulated accordingly. Alternatively, segregated collections can be disassembled and the individual products returned to a storage of the appropriate individual product.

As a rule the specified quantity of individual product types is the same for a multitude of collections produced in succession. This quantity is a sub-quantity of the individual product types to be supplied, or the total quantity of all individual product types. It is however also possible that the quantity is changed during a course of manufacture or job, e.g. when certain advertising material is added to a part edition of a periodical or newspaper depending on the distribution area.

When, as described below, an actual fault count exceeds a reference fault count, or when a fault quota exceeds a threshold value, the production is automatically switched to a different operating mode. This occurs in dependence on a predetermined monitoring level. In total the following operating modes are used:

1. first operating mode: no fault detection ("switched off"): no detection of supply faults is performed, or relevant sensor signals are ignored in the present processing step. Thus it is possible e.g. to ignore defect sensors so there is no need to delay production.

2. second operating mode: no fault correction ("not monitored"): Supply faults are detected and counted. Faults in the collections are permitted, faulty collections are regarded as correct or faultless and further processed accordingly. However, this does not exclude the use of sensor signals in another processing stage: E.g. several successive supply faults in a supply unit may lead to an alarm signal related to this supply unit and/or activate a stop to production.

3. third operating mode: with fault corrective action ("monitored"): faulty collections are not regarded as correct or faultless and are conveyed to the fault corrective action.

These operating modes are activated according to the specifications of the following monitoring levels:

Level 0: continuously in the first operating mode.

Level 1: continuously in the second operating mode.

Level 2: automatic switch and change between the second and third operating mode: To this end faulty individual products are detected and counted. As described below, the fault count is related to a threshold value. Provided the threshold value, or the reference limit, is not exceeded the second operating mode applies. Exceeding it induces a switch to the third operating mode.

Level 3: continuously in the third operating mode.

The aforementioned setting of monitoring level, quota of faulty collections, switch of operating mode, etc. occur in a preferred embodiment of the invention individually, in parallel and independently for each individual product type. This means, e.g., that for a first individual product type a first threshold value (according to the fault quota defined above) of 5%;

for a second individual product type a second threshold value of 10%; and for a third individual product type a complete fault corrective action (equivalent to a threshold value of zero) can be predetermined; and for a fourth individual product type no faults are registered.

Thus the system can be set, with respect to different individual product types, to different monitoring levels and in different operating modes. In the aforementioned example, the system is continuously set in the first operating mode concerning the fourth individual product type; continuously in the third operating mode concerning the third individual product type; and can switch between the second and third operating mode concerning—and independently of each other—the first and the second individual product types.

There is a multitude of possibilities for the pre-setting of the quota of faulty collections and of the reference limit. The quota may be an absolute quantity of faults in the supply or in the collections conveyed to further processing downstream; or a relative fault count, i.e. in relation to the total quantity of collections produced or conveyed. Advantageously a limit for a measured fault count, or an actual fault count, is continuously calculated and compared to the pre-set reference limit according to a quantity of faulty individual products continuously determined during production In a first preferred variant of the invention, the actual fault count is a quantity of collections with a supply fault concerning a particular individual product type regarded as faultless, and the reference limit is in proportion to a quantity of collections produced so far; is therefore continuously calculated. The quantity of collections produced so far covers either all collections regarded as faultless, including those where a faulty individual product was tolerated ("job counter"), or only those collections regarded as faultless which actually comprise the particular individual product without supply fault ("individual product counter").

It is mathematically equivalent to the comparison with the reference limit, to continuously calculate a fault quota, or ratio, of (quantity of collections regarded as faultless with a supply fault concerning a particular individual product type)/(quantity of collections produced so far), and to compare this ratio with a threshold value.

This first variant results in faults in a moderately performing machine being distributed across a course of manufacture or job. In machines performing well, a reserve of permissible faults can accumulate which may tolerate a large number of faults in close succession towards the end of the production.

In a second preferred variant of the invention, the actual fault count is a quantity of collections with a supply fault concerning a particular individual product type regarded as faultless, and the reference limit is a constant quantity of permissible faults. This results in a large quantity of faults being permitted at the start of the course of a production run. This can be an advantage, as the machines may not perform at their best initially, yet a high productivity is still possible.

Whether the frequency of faults at the start of production poses a disadvantage or whether it can be tolerated depends on the kind of product.

In a modification of the second preferred variant, a reference fault limit concerning the subset of a total job lot is determined and the actual fault count is tallied also only for the subset. To this end e.g. faults are counted in an accompanying time window ("moving average"), or a fault counter for the quantity of faulty copies is periodically reset to zero, which corresponds with a succession of time windows, each with a separate fault counter. This results in faulty collections being evenly distributed across the total job lot.

In a further preferred variant of the invention, not only faults concerning the individual product types, are registered and used in the control of the system independently of other individual product types, but predefined and combined faults are also registered. E.g. it may be predefined that out of two supplements, or individual product types, one each can be faulty (within the bounds of each individually defined reference limit for each part product type), but that under no circumstances both may be faulty. An overriding control system registers the fault indication transmitted from the individual means of supply concerning each collection. If an inadmissible combination of faulty individual products occurs, the collection is segregated. This kind of definition and registration of combined faults can be linked with any one of the various kinds of fault analysis concerning operating mode, reference limit, etc.

In another variant of such an overview of a collection, if a particular individual product is missing, a second individual product is deliberately omitted from the collection. This may be considered when the individual products need not necessarily be present but complement each other with regard to content and only make sense if both present. This of course requires that the second individual product is supplied to the collection downstream from the first.

Methods for monitoring a single means of supply can be employed simultaneously with, but essentially independently of, the method described so far. E.g. repeatedly occurring supply faults or a jam can result in the means of supply and/or the entire gathering installation being switched off. It is equally possible to employ a method and arrangements wherein an individual product type is delivered by two alternating means of supply ("split"), and/or, in the case of a first means failing, it is substituted by a second means of supply for the same individual product type ("backup") situated downstream. From the position of the method according to the invention both means of supply can be regarded as one.

In the description so far attention was given above all to the production of collections which all share the same projected combination. With correspondingly defined actual and reference parameters the invention also lends itself to a production of individually varying collections. Therein the predetermined quantity of individual products of various types is individually determined and variable for each collection. The condition is merely that for at least one individual product type a certain quantity of faults is permissible. Only if, or so long as, an actual fault count exceeds a threshold, a fault corrective action is activated or a separate processing becomes possible.

The control system advantageously comprises storage means with computer program code means stored therein, describing a computer program, and means for data processing for the execution of the computer program, wherein the execution of the computer program leads to the realization of the method according to the invention.

A computer program system for the control of an installation for gathering flexible individual products according to the invention comprises one or several computer programs, each of which can be loaded on to an internal memory of one or several digital data processing units of the control system. Each comprises means of computer program coding which, when executed in a digital data processing unit, induce these to execute the method according to the invention. In a preferred embodiment of the invention, a computer program product comprises a data carrier, or machine-readable medium, upon which the means of coding a computer program are stored.

Further preferred embodiments are evident from the dependent claims.

BRIEF DESCRIPTION OF THE DRAWINGS

In the following the invention is explained in more detail with preferred examples of embodiment illustrated in the enclosed drawings, showing.

The reference symbols used in the drawings and their meaning are listed summarily in the list of reference symbols. In the drawings identical parts are always indicated with identical reference symbols.

DETAILED DESCRIPTION OF THE PREFERRED EMBODIMENTS

Figure 1:
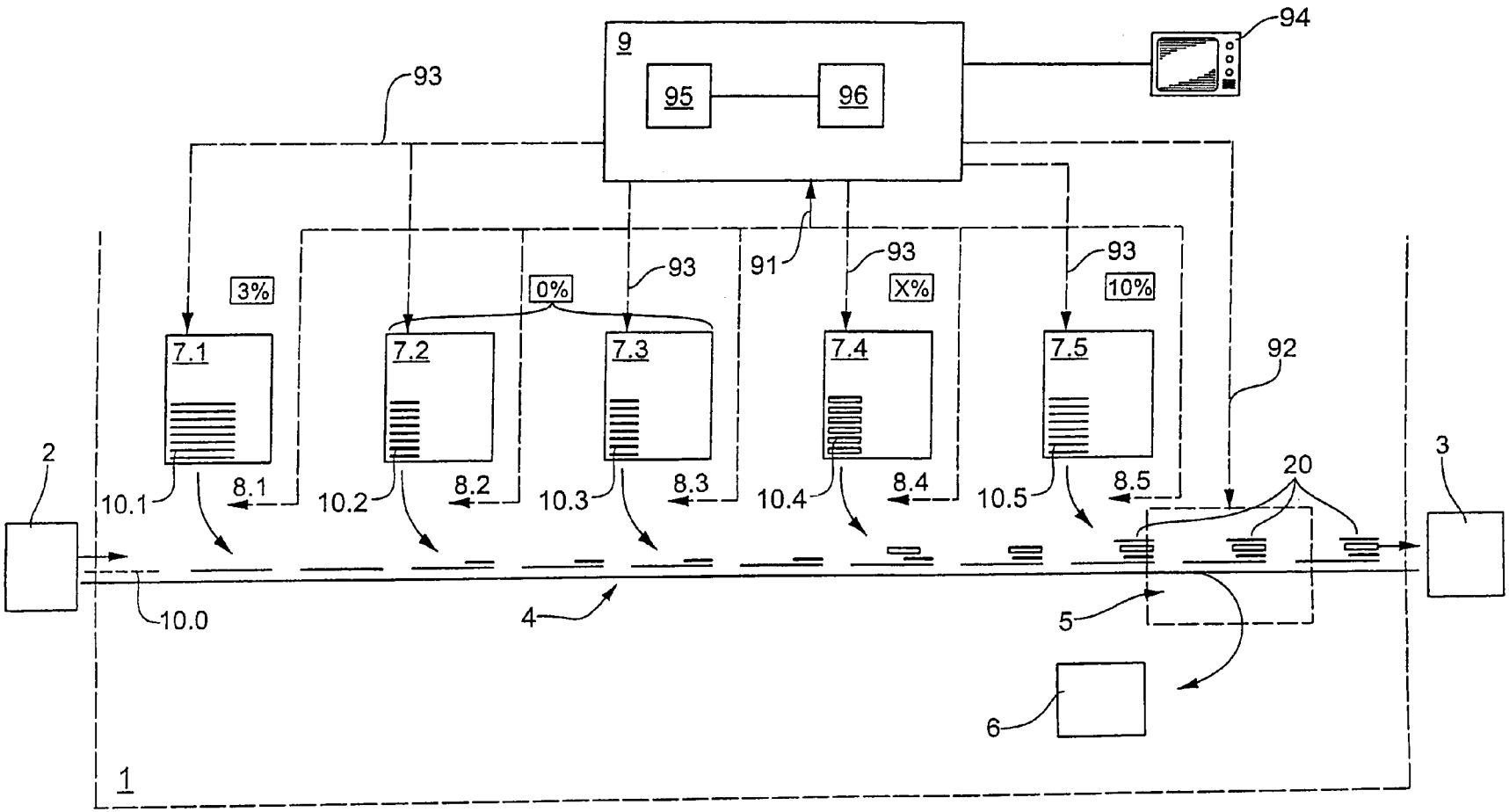
FIG. 1 schematically depicts a structure of a system for gathering with further systems connected thereto.

FIG. 1 shows in a diagram the structure of a system for gathering with further systems connected thereto. In the following an installation for gathering 1 is viewed as a combination of a means to collect 4 with a segregation 5 and several means or systems of supply 7—individually indicated by 7.1, 7.2, 7.3, 7.4 and 7.5. The means of collection 4 is a means of conveyance for collections 20 resulting from gathering, insertion, collection, etc., e.g. a drum or a linear system such as a collection chain or collection track 4. The supply systems 7 are arranged for gathering individual products into the means of collection 4 and each comprises, among other things, sensors with allocated means of evaluation for the fault detection 8, individually indicated by 8.1 to 8.5. Results from the fault detection 8 can be transmitted to a control unit 9 via communication links 91, e.g. a fieldbus. These transmissions can take place directly or via a local control unit of the respective supply system 7. The control unit 9 is equipped among other things for the control 92 of the segregation 5, and optionally also for the control 93 of the supply system 7. This controlling 93 can take place physically via the same fieldbus as the transmission of the fault detection. The control unit 9 comprises a graphic user interface 94 for entering operating parameters and for displaying and monitoring characteristic values of the control during a course of manufacture. One or several graphic user interfaces 94 are implemented at an operating system of the control unit 9 or in a remote computer. The control unit can be structured internally and comprise several spatially distributed units 95, 96. Warning means can be actuated through the control unit 9 or the means of evaluation of the sensors 8.

By means of the supply system 7 the individual products 10, indicated as 10.1 to 10.5 with regard to the relevant supply system 7.1 to 7.5, are gathered into collections 20 on the means of collection 4. Optionally, the means of collection 4 is already supplied with a first individual product 10.0 by a supply of a basic product or main product 2, e.g. a printing machine, situated upstream. The completed collections 20 are delivered downstream to further processing 3, e.g. foil wrapping, packaging, insertion system, etc.

The segregation 5 conveys segregated products or collections 20 to a separate processing 6, wherein the collections 20 are e.g. manually replenished or disassembled into individual products 10. Segregated collections 20 are non-tolerated faulty collections, i.e. regarded as "incorrect". Those conveyed to further processing 3 are tolerated faulty collections, i.e. are regarded as "correct", even if they are faulty. In another embodiment of the invention, a fault corrective action can be implemented in the course of further processing 3 instead of the segregation of non-tolerated faulty collections.

In FIG. 1, as an example, an allocated specification of the tolerated fault quota in percentage is illustrated with each supply system 7. For the first individual product type 10.1 from the first supply system 7.1 a fault quota of 3% is specified. The second and third supply system 7.2, 7.3 deliver the same individual product type and work in the split and/or backup mode. For the second individual product type 10.2 and the identical third individual product type 10.3 a common fault quota of 0% is indicated, i.e. no faults are tolerated. For the fourth part product type 10.4 no value is given, i.e. the fault count is either detected only or even the detection is switched off.

Accordingly, each supply system 7, or the controller thereof, comprises one of the following running states, or operating modes respectively:

1. first operating mode: no fault detection, i.e. fault detection switched off.

2. second operating mode: no fault corrective action ("not monitored"): faulty individual products are detected and counted, but faults are ignored.

3. third operating mode: with fault corrective action ("monitored"): collections missing an individual product are processed separately.

The running states are activated according to the given monitoring level: The control is set to . . .

Level 0: continuously in the first operating mode.

Level 1: continuously in the second operating mode.

Level 2: according to an automatic switch in the second or third operating mode: faulty individual products are detected and counted and the fault count is related to a threshold value. According to this relation, the operating mode is switched between the second and third operating mode.

Level 3: continuously in the third operating mode.

Figure 2:
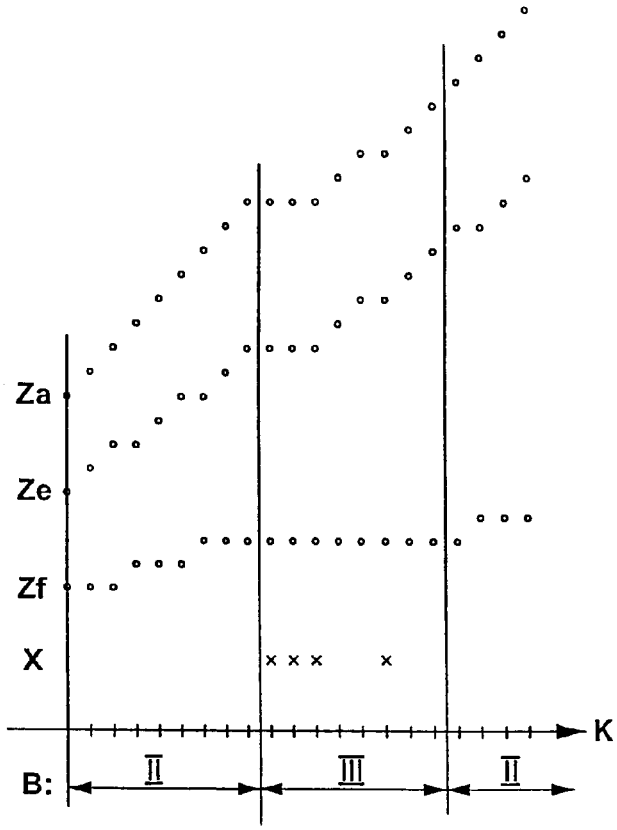
FIGS. 2, 3, 4, 5*a*, 5*b*, 5*c* and 6 depict various courses of characteristic variables of the control according to the invention.

FIGS. 2, 3, 4, 5*a*, 5*b*, 5*c* and 6 explain the method according to the invention by showing various courses of characteristic variables of the control system at the monitoring level 2. FIG. 2 illustrates with regard to a particular supply system 7 for an individual product the course of various counters over time t, or a sequence k, along the horizontal axis.

Several counters are used for each part product type and are updated according to the operating mode and based on measurements of the allocated fault detection 8:

In the third operating mode ("monitored") an individual product 10 must be present faultlessly to permit the collection 20 to be treated as correct.

In the other operating modes a collection 20 is also regarded as correct if the individual product 10 is faulty, in particular if it is missing.

For each individual product type, an individual product counter Ze is maintained. The individual product counter Ze is incremented by one with every faultless individual product 10 present in a correct collection 20 (this means inter alia that the individual product counter Ze does not register a collection 20 that is incorrect due to a fault in another individual product).

For each individual product type, a fault counter Zf is maintained. The fault counter Zf is incremented by one with every faulty individual product 10 present in a correct collection 20.

Thus, provided the fault count is tolerable according to a predetermined criterion, even collections 20 with a faulty individual product 10 are not segregated but regarded as correct and are conveyed to further processing 3, and a job counter Za is incremented. Only if a collection is regarded as incorrect and is conveyed to a fault corrective action, e.g. is segregated (indicated by X), the job counter Za is not incremented and falls behind the production count. The relevant operating mode B is indicated in FIG. 2 by II and III respectively.

Figure 3:
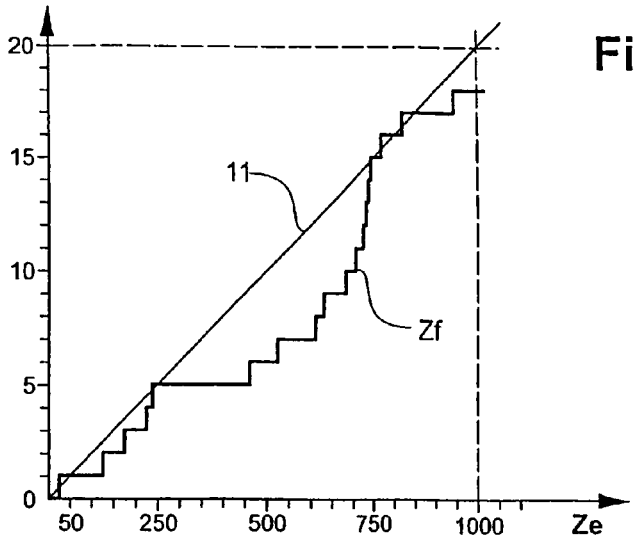

FIG. 3 illustrates the fault analysis with an absolute fault threshold increasing during production. The value of the individual product counter Ze is plotted along the horizontal axis. In proportion to Ze an absolute threshold value 11 proceeds according to the permissible fault quota, i.e. a threshold value relating to an absolute quantity of faults Zf. An exemplary course is shown for a fault quota, or fault rate, of 2% in relation to Ze. At the start of production the counters for Ze and Zf are set at zero. The threshold value 11 is adjusted in proportion to Ze. Provided the fault count remains below the threshold 11, collections 20 with faulty individual products 10 are not segregated according to the second operating mode. As soon as Zf exceeds the threshold such collections 20 are segregated according to the third operating mode. With Ze increasing Zf will fall below the threshold again and is switched back into the second operating mode. This switching between the second and third operating mode can occur repeatedly during production.

With this trajectory of the absolute threshold value 11 being in proportion to the individual product counter Ze it may happen that the permissible fault quota is not exhausted because, as experience shows, faults occur frequently at the start of production. As the threshold 11 is low at the start the faults are segregated. During the remaining production and with a machine performing well the fault counter may remain ever further below the threshold. The net performance across the entire production therefore is—in favour of avoiding an excessive amount of faults at the start of production—not maximum.

In another variant of the invention according to FIG. 3, the threshold is defined in proportion to the job counter Za instead of the individual product counter Ze. If faults of the individual product 10 are frequent on average the faults distribute evenly across the entire order run. If the fault count is low at the start, a large "fault reserve" builds up towards the end of production, which in certain circumstances may be exploited in one piece, i.e. by a sequence of consecutive faults.

Figure 4:
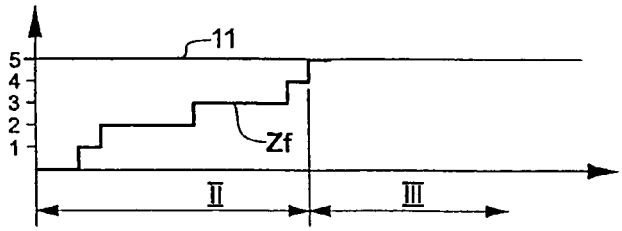

FIG. 4 illustrates the fault analysis for a threshold remaining constant during production. The absolute threshold value 11 is a maximum permissible quantity of tolerated faulty collections for the entire production process or job. A start is made in the second operating mode and the fault counter Zf is continuously updated. If the constant threshold 11 is exceeded, there is a switch to the third operation mode and this third operation mode is retained throughout the rest of production. Alternatively the production can be interrupted when this or a further threshold is exceeded, whereupon the machines are readjusted and the production started afresh.

Thus the total quantity of permissible faults is available at the start of production. In this manner, faults can accumulate at the start. The fault reserve can be exhausted at the start of production. Thus a higher production capacity is achieved at the start compared with one of the embodiments according to FIG. 3. However, the faults are not evenly distributed across the production. Whether this feature is on the whole an advantage or a disadvantage depends on the characteristics of the product.

The absolute threshold value 11 can be determined by a user specification as absolute specification for the fault counter Zf. The absolute threshold value 11 can however also be calculated automatically from a user specification for a maximum fault quota. E.g. a specified percentage relating to the job size can be determined, or a specified percentage relating to the quantity of copies of the individual product 10 to be delivered during a part of the course of manufacture.

FIG. 5 illustrates the fault analysis for a threshold proceeding constantly during production with periodical re-setting of the absolute fault count Zf, or the corresponding counter to zero. A job is viewed as consisting of several sections with a portion of products or copies in each, and a maximum fault count is allocated to each section. This results in a step-by-step course of the absolute threshold value 11. At the start of each section the fault counter Zf is set to zero and switched to the second operating mode if this is not already activated. If the fault counter Zf exceeds the absolute threshold value 11, the rest of the section will be switched to the third operating mode. Thus in each section the fault quota is limited to the relevant predetermined maximum fault count.

Figure 5A:
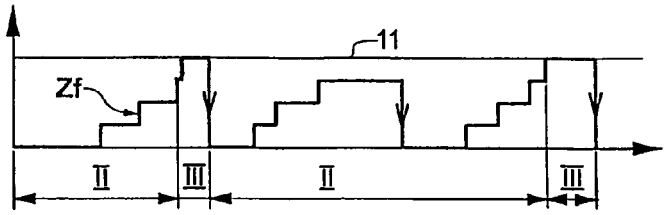
Figure 5B:
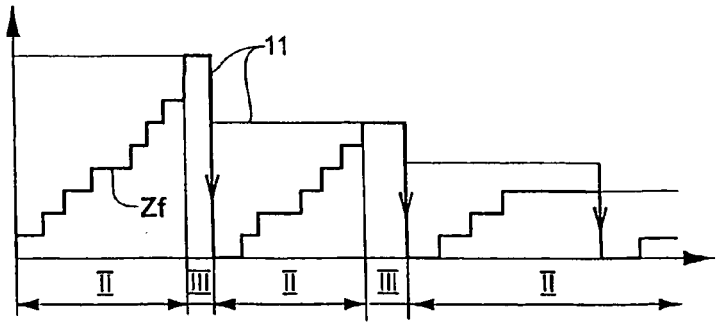
Figure 5C:
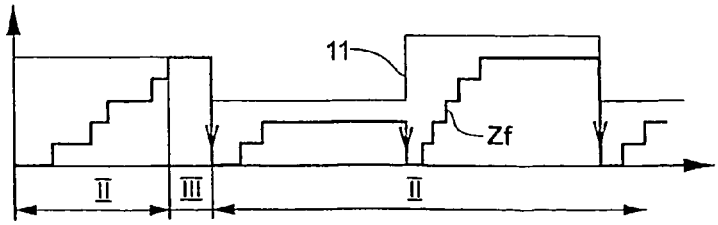

The maximum fault count can thus be determined selectively across the sections. It can be the same for all sections (FIG. 5*a*), or it can drop monotonically (FIG. 5*b*), or it can be varied (FIG. 5*c*). The variant according to FIG. 5*b* grants a higher but controlled fault quota at the start of production. The variant according to FIG. 5*c* grants production of individual section sequences of adjusted quality. This is useful e.g. if a change of product takes place in one of the supply systems 7 during the course of manufacture.

Figure 6:
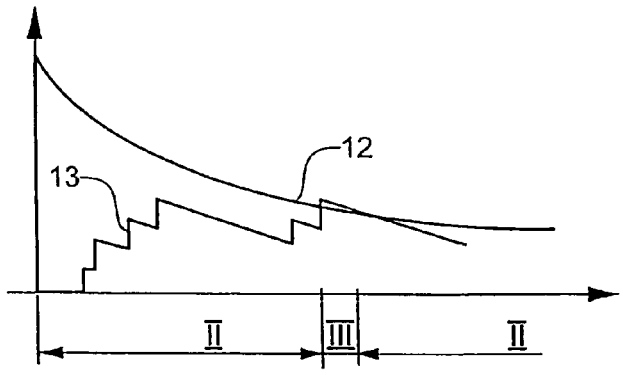

FIG. 6 illustrates a further preferred variant of the invention, wherein a fault quota is determined as a relative threshold value 12 or a threshold value for the fault quota depending on the value of the individual product counter Ze or of the job counter Za. Similarly to the hitherto described embodiments of the invention, the relative threshold value 12 is compared with a relative fault count 13, whereby the switch between the second and third operating mode is controlled. The relative fault count 13 is calculated e.g. as fault quota, or fault rate, in an intermittently relocated section of the production, in the sense of a "moving average" or low-pass filter. This variant corresponds with a quasi-continuous conversion of the variant described in connection with FIG. 5. Similarly, the determined relative threshold value 12 can be constant, decrease monotonically, or decrease and increase in turns.

Figure 7:
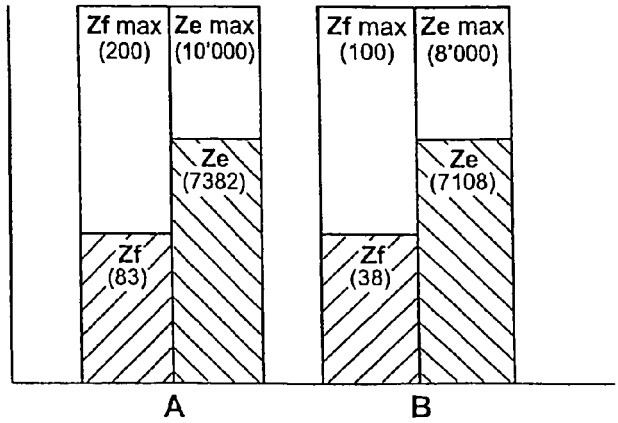
FIG. 7 is an example of a graphic display of characteristic values of the control.

FIG. 7 shows an example for a graphic output of characteristic values of the control. In a bar chart or an equivalent diagram the fault count Zf, a maximum fault count permissible for the entire production Zfmax, and the progress of the individual product counter Ze or of the job counter Za relative to the predetermined quantity of individual products Zemax, or of the job Zamax respectively, are displayed for each supply system 7. Shown schematically in the figure is an exemplary display for two of several supply systems 7, marked A and B.

A graphic display can also comprise representations according to any one or several of FIGS. 3 to 6. Therein the course of the threshold value 11,12 across the production is advantageously displayed during a course of manufacture, and the representation of the actual fault count Zf or of the fault rate 13 is continuously updated. The threshold value for the fault rate can also be updated by an intelligent or adaptive regulation based on measured or estimated machine parameters.

A user interface for the input of control parameters for the method according to the invention allows for each individual product an input of the monitoring level and, for the second monitoring level, an input of the permissible maximum fault quota. This fault quota can be specified either as an absolute quantity or as a relative value, e.g. as a percentage, in relation to the quantity of individual products or in relation to the total job.

A control system according to the invention results from the implementation of the method according to the invention upon a control system however structured. In a preferred embodiment of the invention the control unit 9 is internally structured and spatially arranged such that the supply systems 7 are monitored and controlled by a common control computer 95 comprising its own user interface, and the gathering route 4 with the segregation 5 is monitored and controlled by a further control computer 96.

At the user interface of the supply system 7, e.g., it is defined which one of the individual products 10 is allocated to which supply system 7 or, in the case of a split or backup process, allocated to several supply systems 7, and the relevant control parameters are entered. The monitoring of faults and the switch of operating modes are performed by the common control computer 95 of the supply systems 7. Control orders relating to incomplete products, or to activate the segregation 5, are transmitted through a communication bus to the control computer 96 for the gathering route 4.

LIST OF REFERENCE SYMBOLS

1 installation for gathering
2 supply of a main product
3 further processing
4 means of collection
5 segregation
6 separate processing
7.1, . . . , 7.5 supply system, feeding attachment with charge
8.1, . . . , 8.5 fault detection
9 control unit
91 communication link
92 selection of the segregation
93 selection of supply systems
94 graphic interface
95 shared control computer of the supply systems
96 control computer for the collection route
10.0, . . . , 10.5 individual products
11 absolute threshold value
12 relative threshold value
13 relative fault count
20 collection

The invention claimed is:

1. A method for controlling an installation for gathering (1) flexible part products (10; 10.1, 10.2, 10.3, 10.4, 10.5), comprising the steps of gathering part products (10; 10.1, 10.2, 10.3, 10.4, 10.5) from supplying streams of one individual product type each;

forming a stream of collections (20) and conveying the collections (20) to further processing operations (3), wherein each collection (20) consists of a predetermined quantity of part products (10; 10.1, 10.2, 10.3, 10.4, 10.5); and computing a quota of faulty collections;

if said quota of faulty collections does not exceed a predetermined reference limit, regarding the faulty collections (20) as faultless collections and processing the faulty collections (20) like faultless collections, and if said quota of faulty collections does exceed the predetermined reference limit, performing a fault corrective action.

2. The method according to claim 1, wherein the fault corrective action includes at least one of either marking, segregating (5), or replenishing faulty collections, or restoring faulty collections to the installation for gathering (1).

3. The method according to claim 1, further comprising a repeated execution of the following steps:

predetermining at least one reference limit with regard to supply faults in a collection;

detecting whether a collection (20) comprises at least one supply fault, and calculating, from the detected at least one supply fault, at least one actual fault count representing the quota of faulty collections; and if the actual fault count does not exceed an allocated reference limit, processing the faulty collections (20) as faultless collections (20); and if the actual fault count does exceed the allocated reference limit, performing the fault corrective action for faulty collections (20).

4. The method according to claim 1, comprising the further step of calculating the quota of faulty collections for a particular individual product type according to a quantity of collections regarded as faultless with a supply fault concerning said particular individual product type, relative to a quantity of collections regarded as faultless without a supply fault concerning this individual product type.

5. The method according to claim 1, comprising the further step of calculating the quota of faulty collections for a particular individual product type according to a quantity of collections regarded as faultless with a supply fault concerning said particular individual product type, relative to a total quantity of collections regarded as faultless.

6. The method according to claim 1, comprising the further step of determining the quota of faulty collections for a particular individual product type as being a quantity of collections regarded as faultless with a supply fault concerning said particular individual product type.

7. The method according to claim 4, wherein the quantity of supply faults is only counted within a section of the production order.

8. The method according to claim 5, wherein the quantity of supply faults is only counted within a section of the production order.

9. The method according to claim 6, wherein the quantity of supply faults is only counted within a section of the production order.

10. The method according to claim 1, comprising the further step of determining the quota of faulty collections from a number of collections comprising a predetermined combination of two or more supply faults.

11. The method according to claim 1, further comprising at least one of the steps of generating a warning and interrupting the production, if a fault characteristic concerning a particular part product type (10; 10.1, 10.2, 10.3, 10.4, 10.5) fulfils a predetermined condition.

12. The method of claim 1, further comprising the step of:

providing a computer program system comprising a computer and one or several computer programs which can be loaded and executed on one or several data processing units, the computer programs being executable by a processor to:

control an installation for gathering part products (10, 10.1, 10.2, 10.3, 10.4, 10.5), control an installation for forming and conveying a stream of collections, and compute a quota of faulty collections.

13. An article of manufacture comprising a program storage medium readable by a computer and embodying one or more instructions executable by the computer to perform method steps for executing a command to perform an operation on a related installation connected to the computer, the method steps comprising:

controlling the installation to gather part products (10; 10.1, 10.2, 10.3, 10.4, 10.5) from supplying streams of one individual product type each;

controlling the installation to form a stream of collections (20) and conveying the collections (20) to further processing operations (3), wherein each collection (20) consists of a predetermined quantity of part products (10; 10.1, 10.2, 10.3, 10.4, 10.5); and computing a quota of faulty collections;

if said quota of faulty collections does not exceed a predetermined reference limit, regarding the faulty collections (20) as faultless collections and processing the faulty collections (20) like faultless collections, and if said quota of faulty collections does exceed the predetermined reference limit, performing a fault corrective action.

14. A control system (9) for controlling an installation for gathering (1) flexible individual products (10; 10.1, 10.2, 10.3, 10.4, 10.5), in which installation a stream of collections (20) from supplied streams each of one individual product type are formed and conveyed to further processing (3), wherein a collection (20) consists of a predetermined quantity of individual products (10; 10.1, 10.2, 10.3, 10.4, 10.5), wherein the control system (9) comprises means to execute the method according to claim 1.

* * * * *